US005249981A

United States Patent [19]

Abell et al.

[11] Patent Number: 5,249,981

[45] Date of Patent: Oct. 5, 1993

[54] MULTIPLE CONNECTOR INTERFACE ASSEMBLY

[75] Inventors: Scott T. Abell, Longmont; William J. Benker, Denver; Bernard A. Johnson, Thornton, all of Colo.

[73] Assignee: Storage Technology Corporation, Louisville, Colo.

[21] Appl. No.: 853,508

[22] Filed: Mar. 18, 1992

[51] Int. Cl.[5] ..... H01R 13/62

[52] U.S. Cl. ..... 439/540; 439/550

[58] Field of Search ..... 439/540, 544, 550, 571-573; 361/413

[56] References Cited

U.S. PATENT DOCUMENTS

| | | | |
|---|---|---|---|
| 3,950,058 | 4/1976 | Cronin | 439/540 |
| 4,155,109 | 5/1979 | Finch et al. | 361/413 |
| 4,235,496 | 11/1980 | Aug et al. | 361/413 X |

*Primary Examiner*—Eugene F. Desmond
*Attorney, Agent, or Firm*—Duft, Graziano & Forest

[57] ABSTRACT

Multiple connector interface assembly is used to connect cables to a peripheral device. The connector interface assembly includes a conductive body having a plurality of connector alignment slots. Mating female cable connectors are mounted on a printed circuit board and aligned within each connector alignment slot. Printed circuit board connectors are mounted on the rear of the printed circuit board with signal paths leading from the female cable connectors to the rear mounted printed circuit board connectors. The printed circuit board connectors are plugged directly into the motherboard of the peripheral device to eliminate the need for additional interfaces. Cable connectors are inserted in the connector alignment slots and connect with the mating female cable connectors. Thus, the connector alignment slots physically protect the cable connectors from damage due to misalignment as well as support the cable connectors. The interface assembly also provides electromagnetic interference shielding and protection from accidental electrostatic discharge.

15 Claims, 4 Drawing Sheets

MULTIPLE CONNECTOR INTERFACE ASSEMBLY

FIELD OF THE INVENTION

This invention relates to the field of cable connector interfaces and particularly to a connector interface assembly that provides physical protection for both multiple pin connectors attached to cables and interfaces with printed circuit boards, and to apparatus that shields the cable connectors from electromagnetic interference and electrostatic discharge.

PROBLEM

Cables having multiple pin connectors, commonly known as serpent connectors, are used to interconnect computer systems and peripheral devices, such as data storage systems. These serpent connectors are often connected to relatively heavy cables which interconnect the channel interfaces of both the computer systems and the peripheral devices. In large computer systems, many serpent connectors can be connected to the channel interface of a peripheral device. In the process of installing the serpent connectors to the channel interface, the pins of these multiple pin cable connectors are frequently damaged, typically when the cable connectors are misaligned. In existing computer systems and peripheral devices, there is also little physical support for the cable connectors once the cable connectors have been installed on the channel interface. This lack of support can lead to the pins of the cable connectors being damaged by movement of the cable connectors or during installation or removal of adjacent cable connectors. The time and cost of repairing or replacing the damaged pins in a serpent connector is quite prohibitive considering the connector assembly time, the connector installation time and the down time of the computer system or peripheral device.

Another problem arising from the use of the serpent connectors as cable connectors is the number of parts required to interface the cable connectors to the peripheral device. Typically, the serpent connectors are connected to a channel interface, which then requires additional interfaces and/or jumpers to connect the channel interface to the motherboard of the peripheral device. These multiple interfaces are not only space-consuming and costly, but also create problems with electromagnetic interference shielding of the additional parts. Presently, the serpent connectors require application of a conductive coating plated on the cable connectors to shield external sources from electromagnetic interference created by the electrical signals transmitted through the cable connectors. This plating increases the cost of the serpent connectors by approximately 40%. The computer industry is under increased pressure from the Federal Communications Commission in the form of new regulations to further reduce electromagnetic leakage from the cable interfaces. This requires improved plating of the cable connectors which increases the cost of the cable connectors or other shielding mechanisms.

Another problem encountered in the use of the serpent connectors is electrostatic discharge. The connector interface is open, and thus susceptible to electrostatic discharge while the channel cables are being reconfigured. An electrostatic discharge in the cable connection can have devastating results on the motherboard of the peripheral device or computer system.

SOLUTION

The above-described problems are solved and a technical advance achieved in the field by the multiple connector interface assembly for use with cables terminated by multiple pin connectors. The connector interface includes a conductive alignment plate to shield external sources from electromagnetive interference generated by the transmission of electrical signals through the cable connectors. The alignment plate includes a plurality of alignment slots, each of which is sized to receive a multiple pin male cable connector, such as a serpent connector. A printed circuit board, having a plurality of female cable connectors affixed to the front side, is mounted on the rear side of the alignment plate so that the female cable connectors fit within the alignment slots. A support plate is provided between the alignment plate and the printed circuit board to provide additional support for the cable connectors and to minimize any preload on the printed circuit board. Two multiple pin printed circuit board connectors are mounted on the rear side of the printed circuit board to interface with the motherboard of the peripheral device. Additional layers of the printed circuit board map signal transmissions from the female cable connectors on the front side of the printed circuit board to designated pins of the printed circuit board connectors on the rear side of the printed circuit board. Another layer of the printed circuit board is an internal logic ground layer.

The connector interface assembly is installed onto a peripheral device by inserting the printed circuit board connectors on the rear side of the printed circuit board directly into the motherboard of the peripheral device. A locking screw inserted through the connector interface assembly engages a locking hole on the peripheral device to secure the connector interface assembly onto the peripheral device. A plurality of the connector interface assemblies can be installed in close proximity to one another on the peripheral device. The male cable connectors are then inserted into corresponding ones of the alignment slots of the alignment plate and onto the female cable connectors on the front side of the printed circuit board. The alignment slots align the male cable connectors as the male cable connectors are installed onto the female cable connectors. The alignment slots further support the male cable connectors after installation and prevent damage due to accidental jarring or movement of the cables.

The connector interface assembly of the present invention is able to solve the problem of damaged connector pins due to misalignment of the male cable connectors and corresponding female cable connectors during installation of the cable connectors and due to accidental dislodgement of the cable connectors after installation. The conductive nature of the alignment plate also shields external sources and adjacent cable connectors from electromagnetic interference due to electrical transmission through the cable connectors, thereby reducing the need for plating the individual connectors with a conductive coating. The alignment plate also covers the cable connectors to provide protection from electrostatic discharge during installation or reconfiguration of the male cable connectors. This reduces the possibility of damage to the motherboard and circuits of the peripheral device.

The connector interface assembly also greatly reduces the number of parts necessary to connect the computer system to the peripheral devices. The use of the printed circuit board and the connector interface assembly eliminates the need for additional connectors and jumpers. This not only is a savings in the number of parts required but additionally reduces the need for electromagnetic interference shielding.

DETAILED DESCRIPTION

Figure 1:
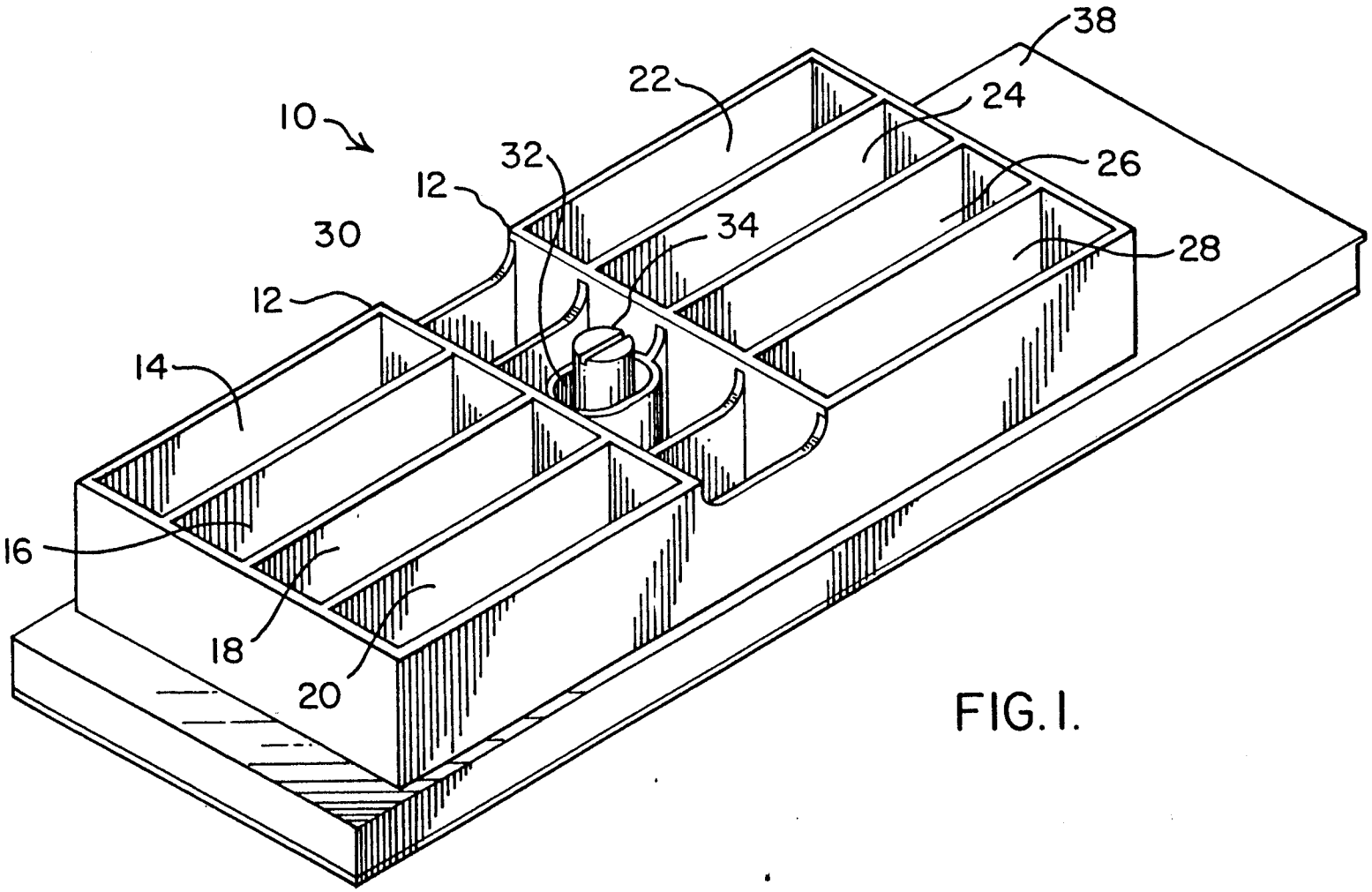
FIG. 1 is a top perspective view of the connector alignment plate of a preferred embodiment of the present invention.

The multiple connector interface assembly of the present invention is uses with multiple pin connectors, particularly serpent connectors, to interconnect a plurality of cable connectors with a peripheral device. Computer systems are interconnected with peripheral devices by relatively heavy and cumbersome cables, typically terminated in multiple pin connectors, such as forty-eight (48) pin male serpent connectors. The orientation of male and female connectors on the cable and connector interface assembly, respectively are a matter of design choice and could be reversed if so desired. Large computer systems and peripheral devices, such as data storage systems, are interconnected via channel interfaces which are interconnected by a plurality of cables. Each cable is terminated with multiple pin cable connectors to enable a user to plug together these devices. Each peripheral device may require a large number of these cable connectors attached to its channel interface in a densely packed configuration. Therefore, an efficient cable connector interface is required to enable a peripheral device to efficiently connect to multiple cables.

A preferred embodiment of the present invention is illustrated in FIGS. 1-6. It is to be expressly understood that this descriptive embodiment is for explanatory purposes only and is not meant to limit the claimed invention. Other embodiments and modifications are considered to be within the scope of the inventive concept.

Alignment Plate

The connector interface assembly includes alignment plate 10 formed of a conductive material, such as die cast magnesium. Alignment plate 10 may als ırmed of other conductive materials that provide electromagnetic interference shielding capability. Alignment plate 10 includes an upstanding portion 12 having a plurality of alignment slots 14–28 dimensioned for the cable connectors (not shown) of the cables (not shown) to fit closely within. Alignment slots 14–28 are oriented into two rows of contiguous slots although other configurations are also possible and anticipated. Each alignment slot 14–28 includes side walls, constructed of the conductive material, and located between adjacent slots to provide electromagnetic interference shielding between the cable connectors. In the preferred embodiment, the side walls completely encircle each of alignment slots 14–28. Alignment plate 10 also includes a reduced center portion 30 having a central hole 32 formed therein. Locking screw 34 is fitted in central hole 32 for securing alignment plate 10 to the system on which alignment plate 10 is installed. Upper portion 38 of alignment plate 10 extends beyond upstanding portion 12.

Figure 2:
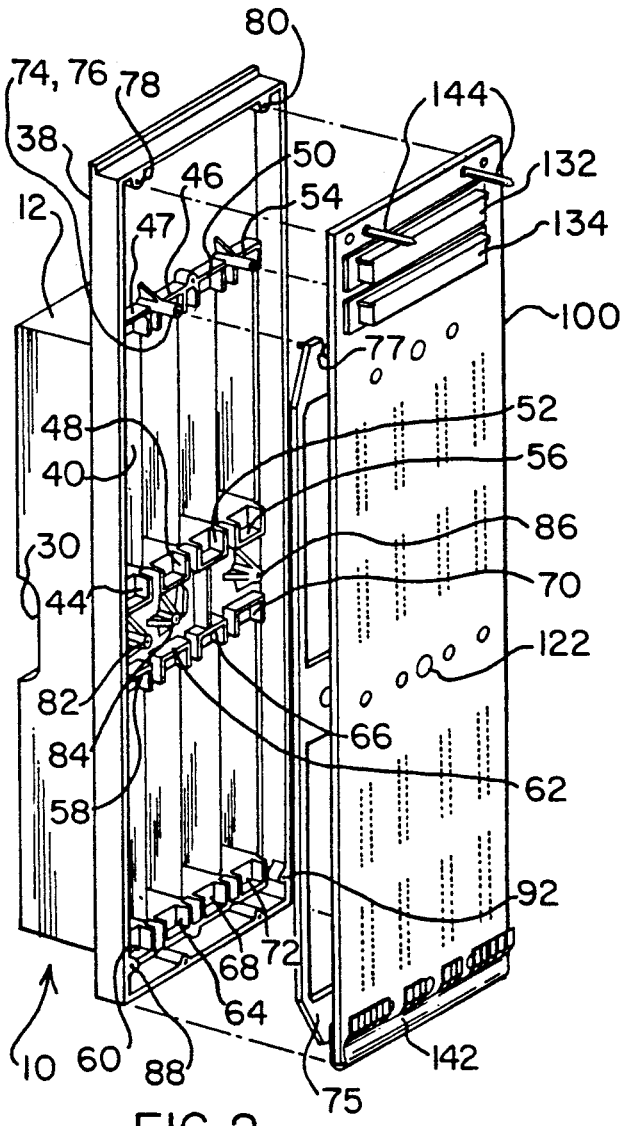
FIG. 2 is a rear perspective view of the connector interface assembly of the embodiment of FIG. 1 with the printed circuit board shown in an exploded view.

Alignment plate 10, as shown in FIG. 2, includes upper and lower alignment brackets 42–72 formed on the upper and lower ends of alignment slots 14–28, respectively within recess 40 of alignment plate 10. Protruding members 74, 76, having inner threaded portions, extend perpendicularly outward of recess 40, as discussed below. Threaded holes 77, 79 are formed in the lower edge portion of alignment plate 10, also as discussed below. Holes 78–90 are also formed within recess 40 or on the perimeter of the rear of alignment plate 10.

Support Plate

Support plate 75, preferably made of metallic material, is inserted into the rear of alignment plate 10 within recess 40, as shown in FIG. 2, and fastened thereto by four screws 87 (only one of which is shown) inserted through slots 70 on support plate 75. Screws 87 engage in the threaded holes of protruding members 74, 76 and holes 77, 79 to secure support plate 75 to alignment plate 10. Support plate 75 includes substantially rectangular cut-out portions 81, 83 which are aligned with alignment slots 14–28 on alignment plate 10.

Printed Circuit Board

Figure 4:
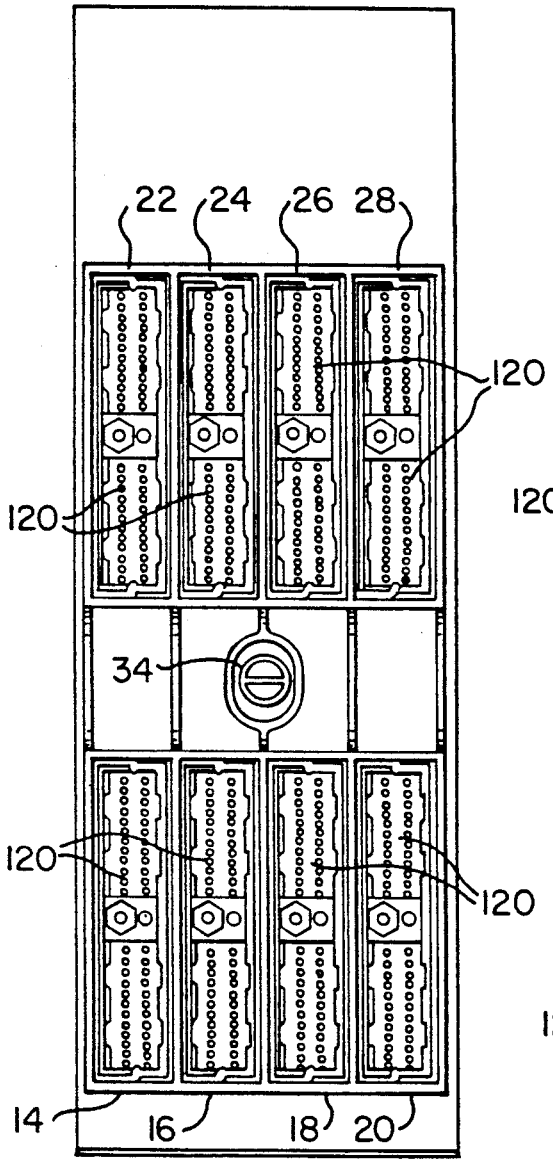
FIG. 4 is a front view of the embodiment of FIG. 1.
Figure 5:
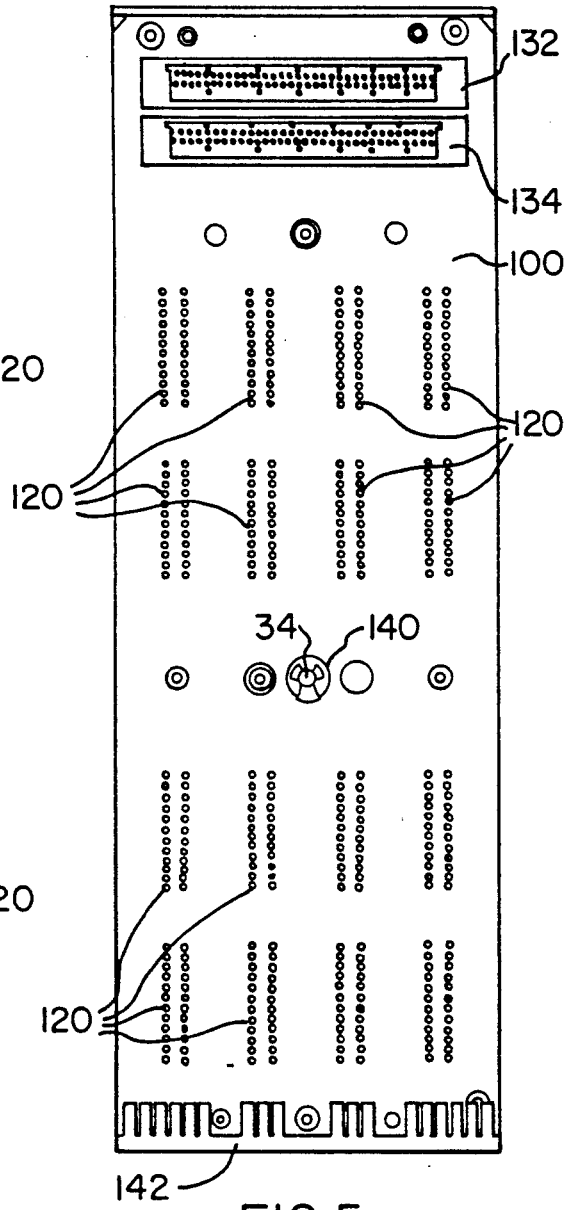
FIG. 5 is a rear view of the embodiment of FIG. 1.

Printed circuit board 100 is secured to the rear of alignment plate 10 over support plate 75. Printed circuit board 100 is secured to alignment plate 10 by pins or screws extending through printed circuit board 100 into holes 78, 82, 84, 86, 88 and 90. Printed circuit board 100, in the preferred embodiment shown in FIGS. 4 and 5, is formed of four layers (not shown). The first layer of printed circuit board 100 includes a plurality of female cable connectors 120 arranged in a mating pattern with alignment slots 14–28 of alignment plate 10. The third layer of printed circuit board 100 is an internal logic ground layer. The fourth layer of printed circuit board 100 includes female printed circuit board connectors 132, 134 extending in the opposite direction of female cable connectors 120 and outward from the rear side of printed circuit board 100. The second layer and fourth layer of printed circuit board 100 provide conductive pathways to transport the signals transmitted through pins of female cable connectors 120 to designated pins on female printed circuit board connectors 132, 134 and vice versa. This eliminates the need for additional connectors or external jumpers as well as provides additional shielding of the electromagnetic interference generated by the transferred signals Female cable connectors 120, shown in FIG. 4, are each secured within alignment slots 14–28 respectively, by alignment brackets 44–72 of alignment slots 14–28 as printed circuit board 100 is secured onto alignment plate 10. Female cable connectors 120 are inserted through cut-out portions 81, 83 of support plate 75. Printed circuit board 100 also includes central hole 122 for locking screw 34 to extend through.

Figure 3:
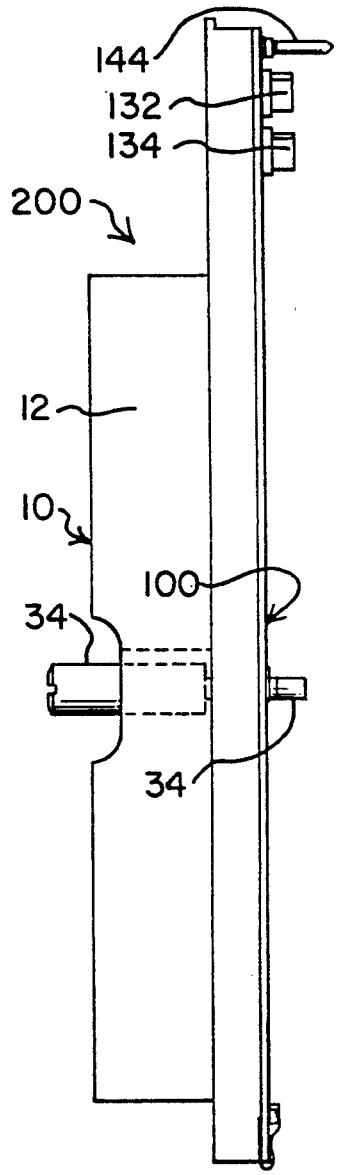
FIG. 3 is a side view of the embodiment of FIG. 1.

The assembled multiple connector interface assembly 200 is shown in FIGS. 3–5. Printed circuit board 100 is attached to alignment plate 10 with the reduced portion of locking screw 34 extending through alignment plate 10 and secured for rotation relative to alignment plate 10 and printed circuit board 100 by snap ring 140. Female cable connectors 120 on printed circuit board 100 are aligned through cut-out portions 81, 83 and in each of alignment slots 14–28 of alignment plate 10, respectively. Female printed circuit board connectors 132, 134 extend perpendicularly outward in a horizontal plane from printed circuit board 100 as shown in FIGS. 3 and 5. Grounding strip 142 is secured to the lower end of printed circuit board 100.

Connector Interface Assembly Installation

Figure 6:
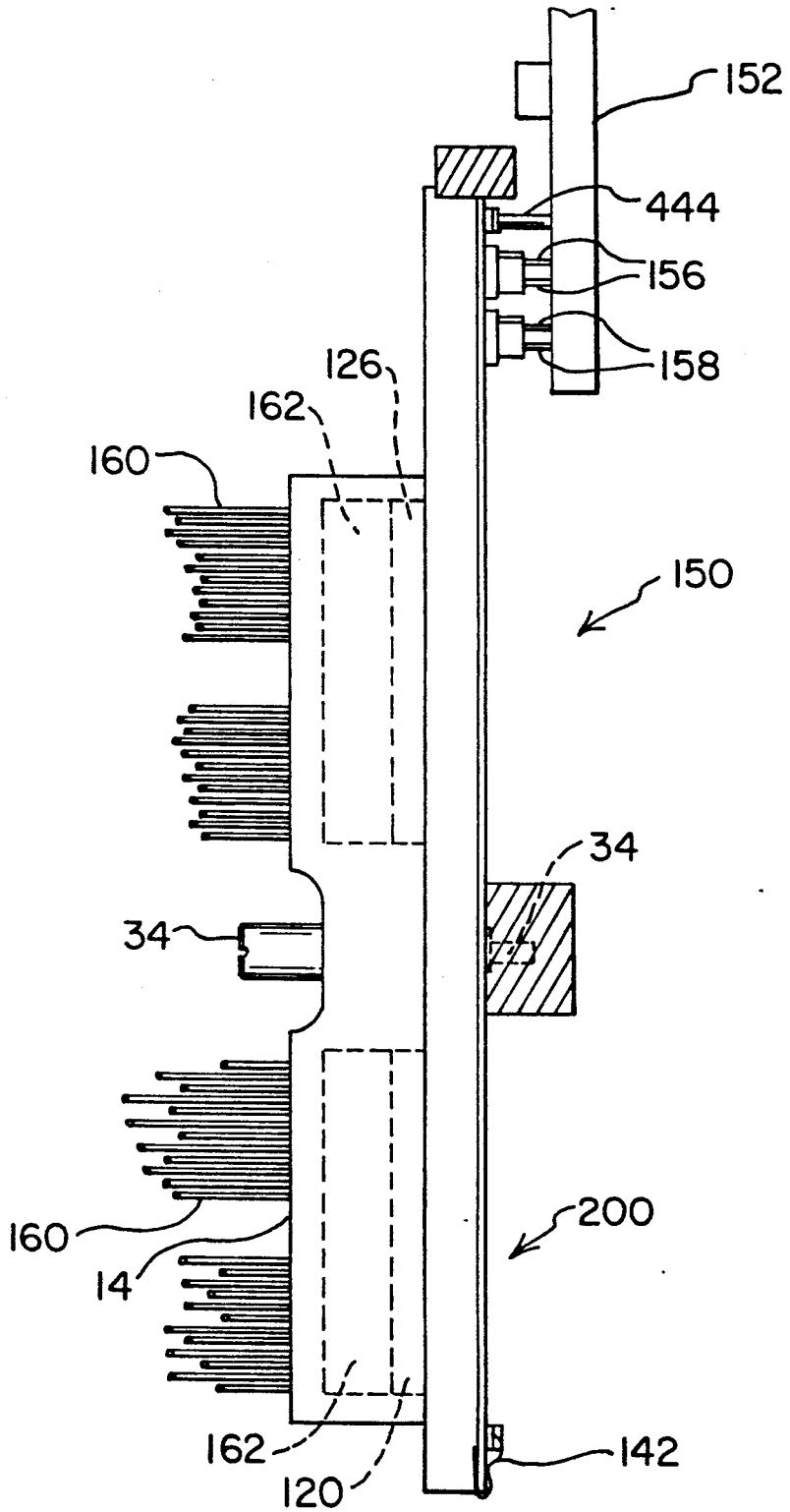
FIG. 6 is a side view of the connector interface assembly of the present invention installed onto a peripheral device.

In operation, multiple connector interface assembly 200 is installed on an electronic device, such as a large computer system and/or a data storage system. As shown in FIG. 6, a plurality of multiple connector interfaces assemblies 200 are mounted onto a peripheral device 150. Connector interface assembly 200 is mounted on peripheral device 150 by aligning pin 144 on the back of printed circuit board 100 into an alignment hole (not shown) on the peripheral device 150. As connector interface assembly 200 is inserted onto peripheral device 150, female printed circuit board connectors 132, 134 are inserted onto mating male printed circuit board connectors 156, 158 mounted on motherboard 152 of peripheral device 150. Once connector interface assembly 200 is fully inserted onto peripheral device 150, connector interface assembly 200 is secured by rotation of locking screw 34 in a threaded or cam locking engagement hole (not shown) in peripheral device 150. This provides secure and easy installation of the connector interface assembly 200 onto a selected peripheral device 150.

Once connector interface assemblies 200 have been mounted onto peripheral device 150, male cable connectors 160 are inserted into alignment slots 14–28. Each of alignment slots 14–28 align a corresponding one of male cable connectors 160 relative to female cable connectors 120 to prevent misalignment and bending or breaking of the pins contained therein. This allows rapid attachment of male cable connectors 160 to peripheral device 150. Support plate 75 also provides support to the male cable connectors 160 and eliminates the preload on printed circuit card 100 as male cable connectors 160 are inserted into connector interface assembly 200. Once male cable connectors 160 are inserted and secured to female cable connectors 120, alignment slots 14–28 provide support for the heavy cables to prevent accidental movement of the male cable connectors 160.

Additional Benefits

Another benefit provided by connector interface assembly 200 is the reduced susceptibility to electrostatic discharge as cable connectors 160 are reconfigured. Previously, the connector interface was open, allowing opportunity for accidental electrostatic discharge. Alignment plate 10 of the present invention covers the connector interface to reduce the possibility of electrostatic discharge.

Alignment plate 10 provides electromagnetic interference shielding between the cable connectors as well as between cable connectors and external sources. The conductive nature of the die cast magnesium of alignment plate 10 provides shielding of the electromagnetic interference by providing a Faraday shield not only to external sources but between the individual cable connectors. Further, printed circuit card 100 reduces the number of additional connectors needed to interface cable connectors 160 to peripheral device 150, thus reducing the electromagnetic interference that the additional connectors would generate. This is an increasingly important feature due to Federal Communications Commission interest in reducing this interference to external sources.

Summary

Connector interface assembly 200 provides alignment for the male cable connectors 160, support for the cables, protection from electrostatic discharge and electromagnetic interference shielding and greatly reduces the number of parts required for connecting the cables to peripheral devices. Typical large computer systems may require a large number of interfaces to peripheral devices. The connector interface assembly of the present invention provides a relatively simple device which eliminates the large number of connectors, jumpers, etc, that were previously required.

While a specific embodiment of this invention has been disclosed, it is expected that those skilled in the art can and will design alternate embodiments of this invention that fall within the scope of the appended claims.

We claim:

1. An apparatus for providing an interface between a plurality of cable connectors and an electronic device having at least one device connector, said apparatus comprising:

a connector alignment plate, having a plurality of apertures formed therein for receiving said plurality of cable connectors;

means affixed to said connector alignment plate for interconnecting said plurality of cable connectors to said at least one device connector, comprising:

printed circuit board means affixed to the rear of said connector alignment plate, a plurality of first connectors directly affixed to a first side of said printed circuit board means, each of said first connectors being located adjacent a corresponding one of said plurality of apertures in said connector alignment means, at least one second connector directly affixed to a reverse side of said printed circuit board means for engaging said at least one device connector, said at least one second connector being operatively connected to said plurality of first connectors through said printed circuit board; and connector alignment means formed on said connector alignment plate for aligning said plurality of cable connectors with said plurality of connector means.

2. The apparatus of claim 1 wherein said connector alignment means comprise:

slot means formed in said connector alignment plate adjacent each of said plurality of apertures for aligning said plurality of cable connectors with said plurality of first connectors to prevent misalignment of the pins of said cable connectors with said first connectors.

3. The apparatus of claim 1 wherein said connector alignment means comprises:

means for supporting said cable connectors once said cable connectors are engaged with said first connectors.

4. The apparatus of claim 1 wherein said connector alignment means comprises:

slot means formed in said connector alignment plate adjacent each of said plurality of apertures for aligning said plurality of cable connectors with said plurality of first connectors to prevent misalignment of the pins of said cable connectors with said first connectors; and support walls formed in each of said slot means for supporting said cable connectors once said cable connectors are engaged with said first connectors.

5. The apparatus of claim 1 wherein said connector alignment plate comprises:

means for protecting each of said first connectors from accidental electrostatic discharge.

6. The apparatus of claim 5 wherein said electrostatic discharge protecting means include portions of said connector alignment plate covering the exposed portions of said first connectors.

7. The apparatus of claim 1 wherein said apparatus further comprises:

means for providing electromagnetic interference shielding around each of said first connectors.

8. The apparatus of claim 7 wherein said electromagnetic interference shielding means include forming said connector alignment plate of a conductive material to separate each of said first connector from adjacent ones of said first connectors.

9. An apparatus for providing an interface between a plurality of cable connectors and an electronic device having at least one device connector, said apparatus comprising:

a plurality of connector means for engagement with a like plurality of said cable connectors;

an electrically conductive alignment plate means, having said plurality of connector means affixed to said alignment plate means, for providing electromagnetic interference shielding to said plurality of connector means;

slot means formed in said alignment plate adjacent to and aligned with each of said connector means for aligning said plurality of cable connectors with said connector means to prevent misalignment of the pins of said plurality of cable connectors with said plurality of connector means;

printed circuit card means affixed to the rear of said alignment plate means;

wherein each of said connector means is directly affixed to a first side of said printed circuit card means adjacent a corresponding said slot means; and at least one printed circuit board connector directly affixed to a reverse side of said printed circuit board means for engaging said at least one device connector affixed to said electronic device, said at least one printed circuit board connector being operatively connected to said connector means through said printed circuit board.

10. The apparatus of claim 9 wherein said slot means include:

support walls for supporting said plurality of cable connectors once said cable connectors are engaged with said connector means.

11. The apparatus of claim 9 wherein said alignment plate comprises:

means for protecting each of said plurality of connector means from accidental electrostatic discharge.

12. An interface assembly for providing an interface between cable connectors and an electronic device, said assembly comprising:

printed circuit card means for interfacing between a plurality of cable connectors and an electronic device;

a plurality of first connector means affixed to a first side of said printed circuit card means for engagement with said plurality of cable connectors;

second connector means affixed to a second side of said printed circuit card means for engaging the electronic device and said second connector means are operatively connected to said plurality of first connector means through said printed circuit board; and an electrically conductive alignment plate means affixed to said first side of said printed circuit card means and having said plurality of first connector means affixed within said alignment plate means for providing electromagnetic interference shielding around each of said plurality of first connector means.

13. The assembly of claim 12 wherein said assembly further comprises:

alignment plate means affixed to said first side of said printed circuit card means; and slot means formed in said alignment plate means adjacent to and aligned with each of said plurality of first connector means for aligning said plurality of cable connectors with said plurality of first connector means to prevent misalignment of said cable connectors with said first connector means.

14. The assembly of claim 13 wherein said assembly further comprises:

support walls formed around each of said slot means for providing support to said plurality of cable connectors once said cable connectors are engaged with said first connector means.

15. An interface assembly for providing an interface between cable connectors and an electronic device, said assembly comprising:

printed circuit card means for interfacing between a plurality of cable connectors and an electronic device;

a plurality of first connector means affixed to a first side of said printed circuit card means for engagement with said plurality of cable connectors;

second connector means affixed to a second side of said printed circuit card means for engaging the electronic device and said second connector means are operatively connected to said plurality of first connector means through said printed circuit board; and means for protecting each of said plurality of first connector means and said plurality of cable connectors from accidental electrical discharge.

* * * * *